United States Patent [19]

Piggott

[11] 4,256,260

[45] Mar. 17, 1981

[54] SPRAY HEAD

[76] Inventor: Richard G. Piggott, 936 Marshall Ave., Bellwood, Ill. 60104

[21] Appl. No.: 25,184

[22] Filed: Apr. 23, 1979

[51] Int. Cl.[3] ..... B05B 15/02

[52] U.S. Cl. ..... 239/119; 239/587; 239/600; 285/110

[58] Field of Search ..... 239/119, 600, 392–394, 239/436, 437, 451, 526, 587; 285/110, 261; 277/12 F, 30; 308/36.1, 187.2

[56] References Cited

U.S. PATENT DOCUMENTS

| | | | |
|---|---|---|---|
| 3,421,702 | 1/1969 | O'brien | 239/587 X |
| 3,563,463 | 2/1971 | Walker | 239/119 |
| 3,705,693 | 12/1972 | Franz | 239/600 |
| 3,955,763 | 5/1976 | Pyle et al. | 239/119 |
| 4,025,045 | 5/1977 | Kubiak | 238/600 X |
| 4,074,857 | 2/1978 | Calder | 239/600 X |
| 4,157,163 | 6/1979 | Pinto et al. | 239/600 X |

FOREIGN PATENT DOCUMENTS

| | | | |
|---|---|---|---|
| 1200012 | 7/1970 | United Kingdom | 239/119 |

*Primary Examiner*—Robert B. Reeves

*Assistant Examiner*—Gene A. Church

*Attorney, Agent, or Firm*—Guy A. Greenawalt

[57] ABSTRACT

A spray head which is characterized by a tubular body with an axial bore divided into axially spaced sections of different diameter with the forward section, which is at the discharge end of the head, being of the largest diameter and constituting a chamber in which a spherical spray tip holder is mounted so as to be rotatably seated on the mating inner face of a removably mounted end cap, which holder has a radial socket aligned with a cross bore in the body for receiving a turning member enabling rotation of the tip holder between an operative position for direction of spray material through a discharge aperture in the end cap and a cleaning position for reverse flow of material through the spray tip and a bearing and sealing assembly engaging the tip holder surface opposite its engagement with the end cap which assembly is arranged to minimize the pressure exerted on the tip holder by the spray material and possibly leakage of the product into the tip holder chambers, the latter being provided with a relief opening in the event there is a sealing failure.

7 Claims, 7 Drawing Figures

SPRAY HEAD

BACKGROUND OF THE INVENTION

This invention relates to spray heads or nozzle assemblies for airless spray guns, or the like, and is more particularly concerned with improvements in spray tip mountings which facilitate cleaning and replacement of the spray tip and associated elements and which minimize the risk of possible damage to the tip mounting as a result of operation under pressure.

Spray heads have heretofore been employed in which a tip member for controlling the spray pattern is mounted in a holder which is in turn rotatably mounted in a chamber at the discharge end of the bore in a barrel-like nozzle body, or housing, with associated means for manually turning the tip holder to a position to reverse the direction of the flow of the product or other fluid through the spray tip for cleaning or for clearing a jammed passageway in the spray tip. In some previous designs provision has been made for turning the tip holder to a predetermined position which will permit removal and replacement of the tip through an auxiliary opening in the chamber wall. In previously developed arrangements it has been found that excessive pressure can and does occur, particularly when pluggage of the tip occurs or the holder is moved to a position which blocks the flow of the product, with the results that damage often occurs to the holder and/or associated parts such as the sealing elements.

SUMMARY OF THE INVENTION

It is a general object of the present invention to provide an improved nozzle arrangement which will simplify the mounting of a rotatable tip holder assembly and minimize the pressure on the holder assembly so as to reduce the risk of damage to the assembly when clogging of the spray orifice occurs and cleaning is required.

A more specific object of the invention is to provide a nozzle arrangement in a spray head which includes a generally spherical spray tip holder rotatably mounted in a chamber at the discharge end of the nozzle body and confined therein by a removable cap at the discharge end of the chamber which cap has an inside face mating in bearing forming relation with the curved surface of the tip holder and held in engagement therewith by a bearing and seal forming assembly at the opposite end of the chamber.

Another object of the invention is to provide an improved spray nozzle arrangement wherein a spray tip is mounted in a generally spherical holder seated in a chamber provided at the discharge end of a tubular nozzle body and held in frictional engagement against the inside face of an apertured end cap by a bearing and seal forming assembly mounted at the product receiving end of the chamber which is constructed and mounted therein so as to result in a minimum build up of pressure on the tip holder.

A further object of the invention is to provide an improved arrangement for mounting a tip holder in a spray head which will effectively seal between the tip holder and the openings in the chamber in which the tip holder is confined with associated means for rotating the tip holder between spraying and cleaning positions and with the mounting means being constructed and positioned so as to avoid the application of excessive pressure on the tip holder by the flow of the product.

A still further object of the invention is to provide a spray head which includes a nozzle body having a chamber in which a generally spherical tip holder is rotatably mounted with provision for sealing between the tip holder and opposite ends of the chamber while permitting rotation of the tip holder between spraying and cleaning positions and with a relief opening in the chamber to permit escape of spraying material in the event there is leakage due to failure of the sealing elements.

To this end the invention which is disclosed and claimed herein comprises a spray head having a spray tip mounted in a rotatable tip holder which is disposed in a chamber at the discharge end of a tubular housing forming the body of the spray head, the tip holder being rotatably supported between the product discharge and the product receiving ends of the chamber by bearing formations with the bearing formation at the product receiving end of the chamber forming a seal against escape of the product into the chamber and being constructed and arranged so that there is minimum pressure exerted on the tip holder by the product.

DESCRIPTION OF THE DRAWINGS

The aforesaid objects and other objects and advantages of the invention will become more apparent when reference is made to the accompanying detailed description of the preferred embodiment of the invention which is set forth therein, by way of example, and shown in the accompanying drawings, wherein like reference numerals indicate corresponding parts throughout.

DESCRIPTION OF THE PREFERRED EMBODIMENT

Figures 1, 2, 3, 4, 5, 6, 7:
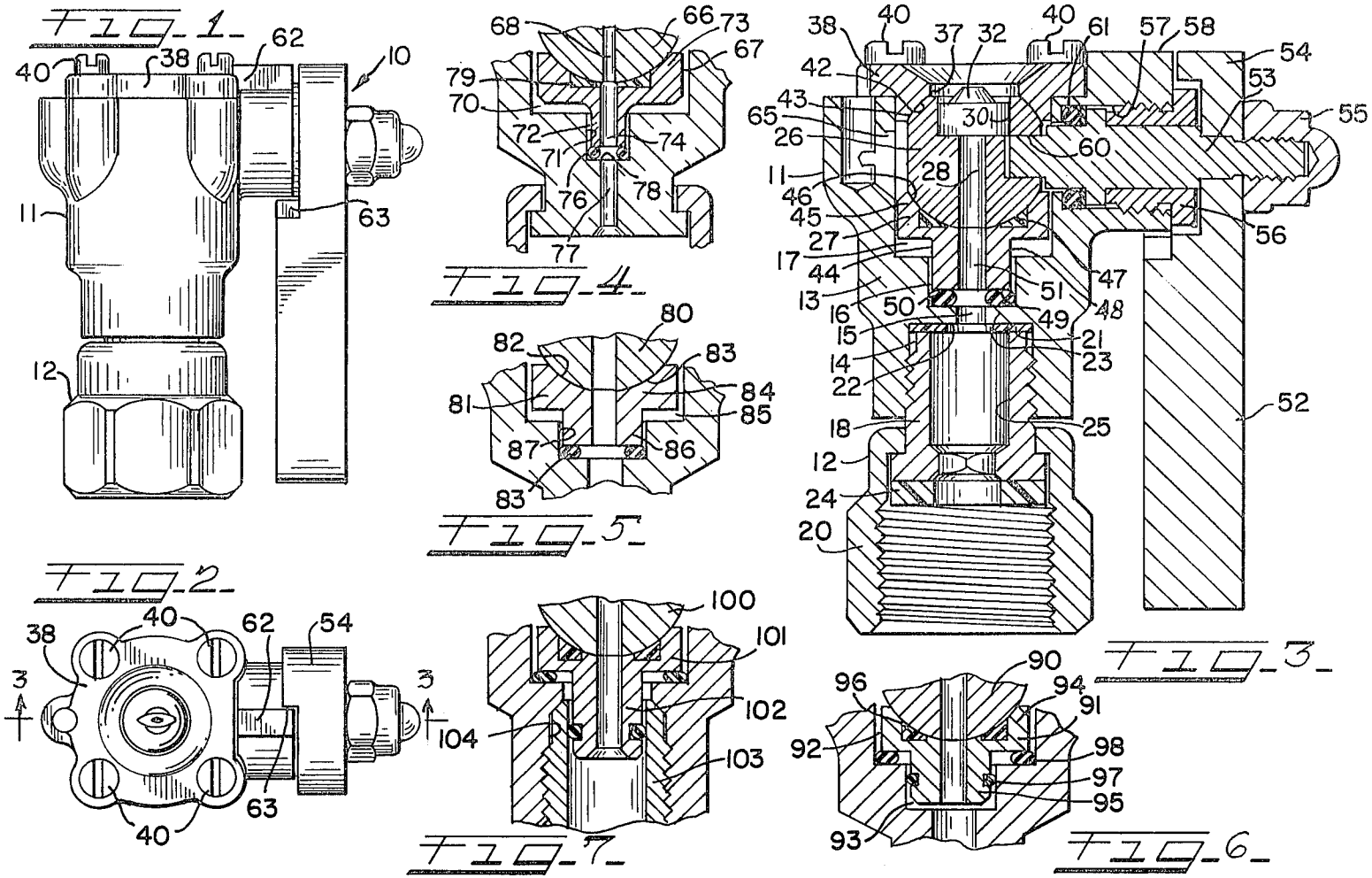
FIG. 1 is a side elevational view of a spray head which incorporates therein the principal features of the invention.
FIG. 2 is an end elevational view of the discharge end of the spray head of FIG. 1.
FIG. 3 is a sectional view taken on the line 3—3 of FIG. 2 to an enlarged scale.
FIGS. 4 to 7 are fragmentary sectional views showing modified forms of an inner seating ring arrangement for the tip holder.

Referring to the drawings there is illustrated in FIGS. 1 to 3 a spray head 10 which is adapted to be attached to a spray gun, a supply conduit, or other source of supply for a liquid product which is to be applied to an object to be treated with the product, which spray head embodies the principal features of the invention. The spray head 10 comprises a nozzle assembly 11 having a coupling 12 at the one end for attaching the nozzle 11 to a source of product supply (not shown). The nozzle assembly 11 comprises a barrel-like housing 13 (FIG. 3) with an axial bore which is divided into axially spaced sections 14, 15, 16 and 17 of different diameter. At the end of the housing 13 which bears the coupling 12 the end section 14 of the bore is of a diameter sufficient to receive in threaded engagement therein a coupling nut adapter 18 and an associated coupling nut 20 with a sealing washer 21 seated on the outer abutment shoulder forming face 22 of an internal flange formation 23 of relatively small axial dimension which extends between sections 14 and 16 in the bore and defines the section 15 of the axial bore which constitutes the smallest diameter section of the bore. A sealing washer or gasket 24 is positioned in the nut 20. The coupling adapter 18, of course, has an axial bore 25 of sufficient diameter to insure free passage of an adequate supply of the product to the opening of the passageway defined by bore section 15 in the flange formation 23. The passageway 15 is of substantially smaller diameter than the bore 25 in the adapter 18. The section 16 of the bore is of larger cross sectional diameter than the passageway 15 while the section 17 of the bore, which is at the discharge end of the body member 13, is of still larger diameter, the cross sectional dimension being sufficiently large to form a chamber for receiving therein, in rotatable rotation, a generally spherical spray tip holder 26 and an associated bearing and seal forming assembly 27 for rotatably supporting the inner end of the holder member 26.

The spherical tip holder 26 has a diametrical bore 28 of relatively small cross sectional diameter with an enlarged diameter portion at one end forming a recess 30 in which the spray tip 32 is adapted to be seated with its discharge passage in communication with the bore 28. In the normal working position the tip holder 26 is disposed as shown in FIG. 3 with the discharge face of the spray tip 32 extending into a larger diameter opening 37 in a cap member 38 at the outer end of the section 17 of the bore in the body 13. The cap member 38 is secured by a set of four machine screws 40, as shown, and may be readily removed to permit removal of the tip holder 26 and associated elements for repair or replacement. The opening 37 in the cap 38 is of somewhat larger diameter than the diameter at 30 in the tip recess in the holder 26 so as to insure that there is no interference with the spray pattern formed. The cap 38 has a relatively narrow internal surface or face 42 extending around the opening 37 which mates with and forms an annular bearing for seating thereon the curved spherical surface 43 on the tip holder 26.

At the inner end of the chamber defined by bore section 17, the bearing and sealing assembly 27, which forms a seat for the holder 26, comprises a metal member 44 with a cup-shaped bearing end 45 formed by a peripheral flange formation providing a relatively narrow annular bearing surface 46 on which the bearing surface 43 of the tip holder 26 rides with a plastic gasket 47, such as, Delrin or Teflon in the cup formation 45 within the confines of the peripheral flange formation. The tip holder surface 43 mates with the annular bearing surface 46 on the cup-like member 45. The member 44 includes a stem portion 48 of substantially lesser diameter than the cup portion 45. The stem portion 48 is received in the section 16 of the bore which has an inside diameter slightly larger than the outside diameter of the stem portion 48. The axial end face 49 of the stem portion 48 is seated on a rubber grommet or O-ring 50 which is compressed upon assembly so that it doubles as a seal and as a spring to hold the sealing gasket 47 against the curved surface 43 of the tip holder 26 and the tip holder surface 43 in engagement with the cap surface 42, even when there is no product pressure in the head. The cup-shaped end 45 of the member 44 has a peripheral or outside diameter which is somewhat less than the inside diameter of the bore section 17, and the stem portion 48 has an outside diameter which is somewhat less than the inside diameter of the bore section 16 while the bore 51 in the stem portion 48 is equal to or smaller than the bore section 15 in the housing and bore section 15 is equal to or greater than the diameter of the bore 28 in the holder 26. The grommet 50 is adapted to prevent material from entering into the chamber 16 while the gasket 47 is adapted to seal against the tip holder surface 43.

The spray tip holder 26 is rotated between spraying and tip cleaning positions by turning a handle 52. The handle 52 has a stem or shaft portion 53 secured in the head 54 of the handle by a nut 55 with the stem 53 extending through the bore of a retaining nut 56 which is in threaded engagement with an opening 57 in a boss 58 on the housing 13 with its end seated in a radial recess 60, of square diameter, in the tip holder 26. The arrangement includes a shaft seal at 61. The boss 58 has a pair of radially projecting, circumferentially spaced, abutment stop members 62 on the outer surface so as to engage cooperating spaced abutment surfaces 63 on the handle head 54 for indexing the tip holder 26 to insure proper positioning for discharge and cleaning operations.

In order to reduce the force placed on the spray tip holder 26 and holder engaging surfaces 42 of the cap 38 at the discharge station or end of chamber 17 it is necessary that the major recess diameter 30 in tip holder 26 be smaller than the major outside diameter of gasket 47 so that leakage does not occur between gasket 47 and the sealing diameter 43 of tip holder 26 when the tip holder 26 is in the clean out position.

In operation the liquid spray material or product passes from the supply source through the relatively large diameter bore 25 in the coupling member 18 and through the small diameter bore section 15 into the small diameter bore 51 in the inner bearing and sealing assembly 27 for the tip holder 26. The rubber grommet 50 prevents the product from entering the bore section 16 while limiting to a minimum the pressure exerted on the stem portion 48 in the axial direction. At the same time the grommet 50 which is compressed in assembly provides sufficient pressure on the bearing assembly 27 to maintain bearing contact between the spherical surface 43 of the tip holder member 26 and the mating surfaces of the inner and outer seating or bearing elements, that is, the outer bearing surface 42, on the inside face of the cap 38, and the inner bearing surface provided by the cup formation 45 in the inner bearing assembly 27. The member 47 functions as a seal for preventing the spray product from escaping into the chamber 17 and confines any pressure on the tip holder 26 due to the spray material to a relatively small amount. The fluid will not flow past the gasket 47 due to the pressure resulting from compression of the gasekt 50 upon assembly and the force difference resulting from the diameter variations of the inside diameter of the gasket 47 and the diameter of the section 16 of the bore of the body member 13, the former being always smaller than the latter.

The inside face forming the bearing surface 42 on the cap need not have a finish surface capable of sealing since liquid should not escape into the chamber 17 unless there is a failure of the sealing element 50 or the sealing element 47 in which event the leakage past these seals will escape through a bleed port 65 provided in the wall of the chamber 17, and exit in the same direction as the spray in normal spraying operation. No pressure will build up in chamber 17 while the port 65 serves also as a safety signal if there is leakage past the sealing elements 47 and 50.

In FIG. 4 of the drawings the tip holder 66 is seated in a modified sealing and bearing arrangement 67. The tip holder 26 which may have a somewhat smaller bore 68 is seated on a sealing and bearing assembly 67, which is of the same general configuration, has somewhat different proportions relative to the bearing assembly 27 in FIG. 3 while the holder accommodating chamber 70 in which it is disposed may be the same proportions as chamber 17 in FIG. 3. The adjoining bore section 71 in which the stem portion 72 of the bearing member 73 is received is of smaller diameter than the bore section 16 of FIG. 3. The stem portion 72 is of smaller outside diameter with a small diameter axial bore 74 for alignment with a bore 75 of substantially the same diameter in the nozzle body at the product receiving end thereof. A rubber grommet 76 is seated on the shoulder 78 confronting the end face of the stem portion 72 and a plastic sealing gasket 79 is seated in the inner cup portion of the assembly 67. Other elements of the assembly correspond to those shown in FIGS. 1 to 3. The grommet 76 is compressed in assembling the elements so as to function as a seal and a spring for holding the mating tip holder and seating surfaces in engagement. The arrangement functions in the same manner as described with respect to the arrangement in FIGS. 1 to 3.

In a further modification shown in FIG. 5 the inner sealing arrangement in which the tip holder 80 is seated may include an all plastic bearing member 81 with an inner cup portion 82 which is provided with a bearing surface 82 mating with the spherical surface 83 of the tip holder 80. The cup portion 84 is disposed in a chamber 85 corresponding to 17 in FIG. 3 while the stem portion 86 of the bearing member 81 is disposed in an adjoining bore section 87 corresponding to bore section 16 of FIG. 3 with a rubber O-ring sealing element 88 serving to hold the surface 82 of the bearing member 81 in engagement with the tip holder surface 83. This arrangement eliminates the need for a secondary gasket in the bearing cup portion 81. The fluid pressure on the assembly is limited to the small amount resulting from fluid engagement with the small area at the end face of the stem portion 86 and the relatively small inside diameter of the O-ring 88.

In the arrangement shown in FIG. 6 the tip holder 90 is seated on a bearing and sealing assembly 91 quite like the corresponding assembly in FIG. 3 while the holder accommodating chamber 92 and adjoining bore section 93 correspond to 17 and 16 in FIG. 3. The assembly 91 has a cup shaped top portion 94, as viewed in FIG. 6, and a stem portion 95 disposed in chambers 92 and 93, respectively. The cup portion 94 has a sealing gasket 96 corresponding to gasket 47 in FIG. 3 while a peripheral O-ring seal 97 prevents leakage of the product around the stem portion 95 and a larger O-ring seal member 98 functions as a spring for holding the sealing surface of the tip holder 90 in engagement with the inner and outer bearing surfaces in the same manner as heretofore described with respect to the other forms of the device which are shown.

In the further modification which is shown in FIG. 7 the tip holder 100 is seated in engagement with a bearing and sealing assembly 101 which differs from the arrangement in FIG. 6 in the axial dimension of the stem portion 102 which is somewhat greater than the stem portion 95 in FIG. 6 and extends into the bore of a coupling member 103 which is engaged in the threaded relation in the end section 104 of the bore in the nozzle housing, the latter being of simplified construction but corresponding basically to the construction in FIG. 3.

What is claimed is:

1. A nozzle assembly for spraying a fluid material which comprises a tubular body having a coupling at one end for attachment to a fluid material supply means, said body having an axial bore which is divided into sections of different cross sectional diameter, a section of large diameter being at the discharge end of the bore which is remote from the coupling and which forms a chamber for receiving a generally spherical spray tip holder and associated bearing forming means for mounting said tip holder for rotation therein, said tip holder having a diametrical bore with an enlarged portion at one end forming a recess for seating therein a spray tip, a readily removable cap mounted on the discharge forming end of said axial bore for retaining said tip holder in said chamber, said cap having a center spray discharge opening of smaller diameter than the diameter of the tip holder and having a narrow inner annular face mating with the curved surface of the tip holder so as to form a bearing for the tip holder, and an inner bearing and sealing assembly in said chamber for cooperation with said cap in supporting said tip holder so that it may be rotated between a spraying position where the bore thereof is axially aligned with the bore in the body to permit passage of the fluid material for spraying and another position where the flow of the fluid material is in the opposite direction through the tip for clearing the tip, said inner bearing and sealing assembly comprising a bearing member with a relatively small axial bore, positioned with a cup shaped end, disposed in said end chamber and forming a seat for said tip holder with bearing and sealing areas mating with the curved surface of said tip holder and a stem forming end portion of substantially lesser cross sectional diameter than the diameter of said cup shaped end portion and extending into a section of the bore of the body which adjoins said end chamber forming section and which is of substantially lesser diameter than said end chamber, said cup shaped portion of said bearing member having an outside diameter substantially greater than the outside diameter of said stem portion with an axially facing shoulder formation between said portions and a sealing gasket between said shoulder formation and an internal confronting shoulder formation separating said body end chamber forming bore section and the adjoining section of the bore of the nozzle body into which said stem portion extends which sealing gasket is precompressed when installed so as to hold the inner and outer bearing surfaces in engagement with the mating surface of said tip holder, said stem portion having an outside diameter somewhat smaller than the diameter of the body bore section into which it extends and a seal forming element of resilient material associated with said stem portion for sealing between an outside face of said stem portion and the confronting inside face of said lesser diameter bore section and arranged so as to permit a minimum of force in an axial direction on the bearing member by the fluid material.

2. A nozzle assembly for spraying a fluid material which comprises a tubular body having a coupling at one end for attachment to a fluid material supply means, said body having an axial bore which is divided into sections of different cross sectional diameter, a section of large diameter being at the discharge end of the bore which is remote from the coupling and which forms a chamber for receiving a generally spherical spray tip holder and associated bearing forming means for mounting said tip holder for rotation therein, said tip holder having a diametrical bore with an enlarged portion at one end forming a recess for seating therein a spray tip, a readily removable cap mounted on the discharge forming end of said axial bore for retaining said tip holder in said chamber, said cap having a center spray discharge opening of smaller diameter than the diameter of the tip holder and having a narrow inner annular face mating with the curved surface of the tip holder so as to form a bearing for the tip holder, and an inner bearing and sealing assembly in said chamber for cooperation with said cap in supporting said tip holder so that it may be rotated between a spraying position where the bore thereof is axially aligned with the bore in the body to permit passage of the fluid material for spraying and another position where the flow of the fluid material is in the opposite direction through the tip for clearing the tip, said inner bearing and sealing assembly comprising a bearing member with a relatively small axial bore, positioned with a cup shaped end, disposed in said end chamber and forming a seat for said tip holder with bearing and sealing areas mating with the curved surface of said tip holder and a stem forming end portion of substantially lesser cross sectional diameter than the diameter of said cup shaped end portion and extending into a section of the bore of the body which adjoins said end chamber forming section and which is of substantially lesser diameter than said end chamber, said stem portion having an outside diameter somewhat smaller than the diameter of the body bore section into which it extends, said stem portion having an annular recess in the face thereof confronting the inner face of the body bore section into which said stem portion extends and a seal forming element of resilient material seated in said annular recess for sealing between an outside face of said stem portion and the confronting inside face of said lesser diameter bore section, and arranged so as to permit a minimum of force in an axial direction on the bearing member by the fluid material.

3. A nozzle assembly for spraying a fluid material which comprises a tubular body having a coupling at one end for attachment to a fluid material supply means, said body having an axial bore which is divided along its axis into sections of different cross sectional diameter, a section of large diameter being at the discharge end of the bore which is remote from the coupling and which large diameter section forms a chamber for receiving a generally spherical spray tip holder and associated bearing forming means for mounting said tip holder for rotation therein, said tip holder having a diametrical bore with an enlarged portion at one end forming a recess for seating therein a spray tip, a readily removable cap mounted on the discharge forming end of said axial bore for retaining said tip holder in said chamber, said cap having a center spray discharge opening of smaller diameter than the diameter of the tip holder and having a narrow inner annular face mating with the curved surface of the tip holder so as to form a bearing for the tip holder, and an inner bearing and sealing assembly in said chamber for cooperation with said cap in supporting said tip holder so that it may be rotated between a spraying position where the bore thereof is axially aligned with the bore in the body to permit passage of the fluid material for spraying and another position where the flow of the fluid material is in the opposite direction through the spray tip for clearing the tip, said inner bearing and sealing assembly comprising a cup shaped bearing member with a relatively small axial bore positioned in said end chamber in axially spaced relation to said retaining cap, said inner bearing member having a narrow annular face mating with the curved surface of said tip holder and forming a seat for said tip holder, and a stem forming end portion on said bearing member which is of substantially lesser cross sectional diameter than the diameter of tip holder engaging end portion, which stem forming portion extends into a section of the bore of the body which adjoins said end chamber forming section and which is of substantially lesser diameter than said end chamber, said stem portion having an outside diameter somewhat smaller than the diameter of the body bore section into which it extends and a seal forming element of resilient material interposed in sealing relation between an outside surface of said stem portion and a confronting surface of said lesser diameter bore section and which is arranged so as to permit passage of the fluid material through the axial bore of said stem portion with a minimum of force in an axial direction being exerted on the bearing member by the fluid material.

4. A nozzle assembly as set forth in claim 3 wherein said readily removable cap has a spray discharge opening of a diameter which is greater than the diameter of the tip holder so as to enable the spray tip to be removed through said opening.

5. A nozzle assembly as set forth in claim 3 wherein said seal forming element which is interposed between the surfaces of said stem portion of said inner bearing member and said bore section is seated in precompressed relation between an end surface of said stem portion and an internal shoulder defining the end of said lesser diameter bore section in which said stem portion extends which resiliently holds said inner bearing member in bearing forming engagement with said tip holder and said tip holder in bearing forming engagement with said cap without reliance upon pressure exerted by the fluid material.

6. A nozzle assembly as set forth in claim 3 wherein said cup shaped end of said inner bearing and sealing member has a tip holder engaging surface defined by a relatively narrow edge portion of an annular outer flange which forms the cup shaped end and an annular plastic sealing gasket seated within said edge portion.

7. A nozzle assembly as set forth in claim 3 wherein said end chamber has a relief opening in the side wall defining said chamber for escape of fluid in the event there is a failure of the sealing elements.

* * * * *